United States Patent [19]

Miyaji et al.

[11] Patent Number: 4,939,547

[45] Date of Patent: Jul. 3, 1990

[54] MULTICOLOR ELECTROPHOTOGRAPHY APPARATUS

[75] Inventors: Noboru Miyaji, Osaka; Hiroshi Terada, Ikoma; Hayato Kamada, Osaka; Hidenori Kunishige, Kyoto, all of Japan

[73] Assignee: Matsushita Electric Industrial Co., Ltd., Japan

[21] Appl. No.: 188,163

[22] Filed: Apr. 15, 1988

[30] Foreign Application Priority Data

| | | | |
|---|---|---|---|
| Apr. 17, 1987 | [JP] | Japan | 62-95663 |
| Apr. 17, 1987 | [JP] | Japan | 62-95665 |
| May 15, 1987 | [JP] | Japan | 62-119445 |
| Nov. 20, 1987 | [JP] | Japan | 62-294424 |
| Dec. 23, 1987 | [JP] | Japan | 62-325814 |
| Dec. 23, 1987 | [JP] | Japan | 62-325815 |

[51] Int. Cl.[5] ..... G03G 15/08

[52] U.S. Cl. ..... 355/245; 355/260; 355/326; 430/120; 430/357; 118/645

[58] Field of Search ..... 355/245, 260, 326; 430/120, 357; 118/645, 653

[56] References Cited

U.S. PATENT DOCUMENTS

| | | | |
|---|---|---|---|
| 4,713,673 | 12/1987 | Kessoku | 355/245 |
| 4,746,951 | 5/1988 | Hayakawa et al. | 355/245 |
| 4,754,301 | 6/1988 | Kasamura et al. | 355/245 |
| 4,801,966 | 1/1989 | Ikeda | 355/245 |

FOREIGN PATENT DOCUMENTS 60-250369 12/1985 Japan .

*Primary Examiner*—A. C. Prescott

*Attorney, Agent, or Firm*—Lowe, Price, LeBlanc, Becker & Shur

[57] ABSTRACT

A multicolor electrophotography apparatus for forming a color image on a rotatable photosensitive device shaped cylindrically and arranged to hold on its circumferential surface an electrostatic image optically formed by an exposing device. The apparatus includes a plurality of developing devices movably provided along the circumference of the photosensitive device for developing a plurality of different-color toner images overlapping each other. Each of the developing devices is selectively driven to take a developing position and a non-developing position, each of the developing devices being closed to photosensitive devices up to the developing position and being separated therefrom up to the non-developing position. When the exposing device is in the non-operated state, at least one of the developing devices takes the developing position and the other developing devices take the non-developing positions.

15 Claims, 11 Drawing Sheets

MULTICOLOR ELECTROPHOTOGRAPHY APPARATUS

BACKGROUND OF THE INVENTION

The present invention relates generally to multicolor electrophotography apparatus such as a color copying machine and color printer, and more particularly to an arrangement for selective operations of developing devices provided around an electrostatic image holding device.

Various types of multicolor electrophotography apparatus have been developed heretofore, one known arrangement is disclosed in Japanese Patent Provisional Publication No. 60-250369 in which, after a formation of a latent image on an image holding device, a developing device selected in accordance with a required color approaches the image holding device and performs the developing process of the latent image in response to an application of a developing control signal, and after termination of the developing process, the selected developing device is separated therefrom with the application of the developing control signal being stopped. Generally, as techniques of separatively keeping the developing devices with respect to the image holding device in the non-developing state are known two methods, one being that the developing device is positioned to be in slightly separated relation to the image holding device and the other being that it is positioned to be in greatly separated relation thereto. However, an important problem in such a slightly separating method is to stably maintain the space therebetween because the unstable positioning of the developing devices causes deterioration of the image quality, thus resulting in requirement of a complex high-accurate mechanism and hence a high manufacturing cost. Furthermore, there is the possibility of irregularity of rotation of the image holding device due to load variations occurring in response to the operation of the developing device, resulting in deterioration of the image quality. On the other hand, any method that greatly separating the image holding device and the developer device causes the drive mechanism of the developing devices to be complex and results in a large space being required due to the great movement of the developing devices.

SUMMARY OF THE INVENTION

The present invention has been developed in order to overcome the disadvantages inherent to the conventional apparatus.

It is therefore an object of the present invention to provide a multicolor electrophotography apparatus which is capable of obtaining a high-quality color image with a simple arrangement.

In accordance with the present invention, there is provided a multicolor electrophotography apparatus comprising: image-holding means substantially shaped cylindrically and arranged to be rotatable about its own axis, the image-holding means being arranged to hold on its circumferential surface an electrostatic image; exposing means for linearly exposing the circumference of the image-holding means in a direction of the axis of the image-holding means so as to form the electrostatic image thereon; a plurality of developing means movably provided along the circumference of the image-holding means, the plurality of developing means developing a plurality of different-color toner images overlapping each other, each of the plurality of developing means having developer-holding means for application of a predetermined developer to the image-holding means; drive means for allowing each of the plurality of developing means to take a developing position and a non-developing position, each of the plurality of developing means being closed to the image-holding means when it is at the developing position and being separated therefrom when it is at the non-developing position; selection means coupled to the drive means for selectively controlling the plurality of developing means so as to selectively perform formations of the plurality of different-color images, the selection means controlling the drive means so that, when the exposing means is in the non-operated state, at least one of the plurality of developing means takes the developing position and the other developing means takes the non-developing position.

Since the selective operations of the plurality of developing means are performed on development such that, in response to disenergization of the exposing means, the plurality of developing means are driven to be moved between the developing position and non-developing position independently of each other, it is possible to secure a stable rotation of the image-holding means, thus resulting in preventing distortion of the image due to the selective operations of the plurality of developing means.

Here, preferably, the plurality of developing means are arranged successively in a direction of the movement of the image-holding means so as to successively form the different-color toner images at different points on said image-holding means, and the length on the image-holding means between an exposing position of the exposing means and the image-forming point of the developing means positioned at the utmost downstream with respect to the movement of the image-holding means being set to be below $\frac{1}{4}$ of the entire circumferential length of the image-holding means. Furthermore, when closing and separating the plurality of developing means to and from the image-holding means, the drive means is arranged so as to rotationally move at least one of the plurality of developing means and horizontally move the other developing means between the developing positions and the non-developing positions.

In accordance with the present invention, there is further provided a multicolor electrophotography apparatus comprising: image-holding means substantially shaped cylindrically and arranged to be rotatable about its own axis, the image-holding means being arranged to hold on its circumferential surface an electrostatic image; exposing means for linearly exposing the circumference of the image-holding means in a direction of the axis of the image-holding means so as to form the electrostatic image thereon; a plurality of developing means movably provided along the circumference of the image-holding means, the plurality of developing means developing a plurality of different-color toner images overlapping each other, each of the plurality of developing means having developer-holding means for application of a predetermined developer to the image-holding means; and rack means for encasing the plurality of developing means, the rack means having guide means whereby each of the plurality of developing means is slidingly movable to be closed toward the image-holding means and separated therefrom in a direction opposite to the closing direction to take a developing position and a non-developing position, the rack means being further arranged such that each of the plurality of developing means is removable therefrom and again inserted thereinto in directions substantially equal to the closing and separating directions.

Preferably, the rack means is arranged to be movable from an operating position to an non-operating position separated from the apparatus and has keeping means whereby each of the plurality of developing devices takes the non-developing position when moved to the non-operating position.

In accordance with the present invention, there is further provided a multicolor electrophotography apparatus comprising: image-holding means arranged to be rotatable about its own axis, said image-holding means being arranged to hold on its circumferential surface an electrostatic image; a plurality of developing means movably provided along the circumference of said image-holding means, said plurality of developing means developing a plurality of different-color toner images overlapping each other; selection means for selectively controlling said plurality of said developing means so as to selectively perform formations of said plurality of different-color images, said selection means performing control so that each of said plurality of developing means takes a developing position and a non-developing position, each of said plurality of developing means being closed to said image-holding means when it is at said developing position and being separated therefrom when it is at said non-developing position; first drive means having first drive source means for driving said image-holding means so as to be rotated about a rotating shaft provided to be coaxially coincident with the axis of said image-holding means; and second drive means having second drive source means to operate each of said plurality of developing means for development, said second drive means being arranged to be engageable with said developing means when said developing means takes said developing position by said selection means and to be disengageable therewith when taking said non-developing position.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 1:
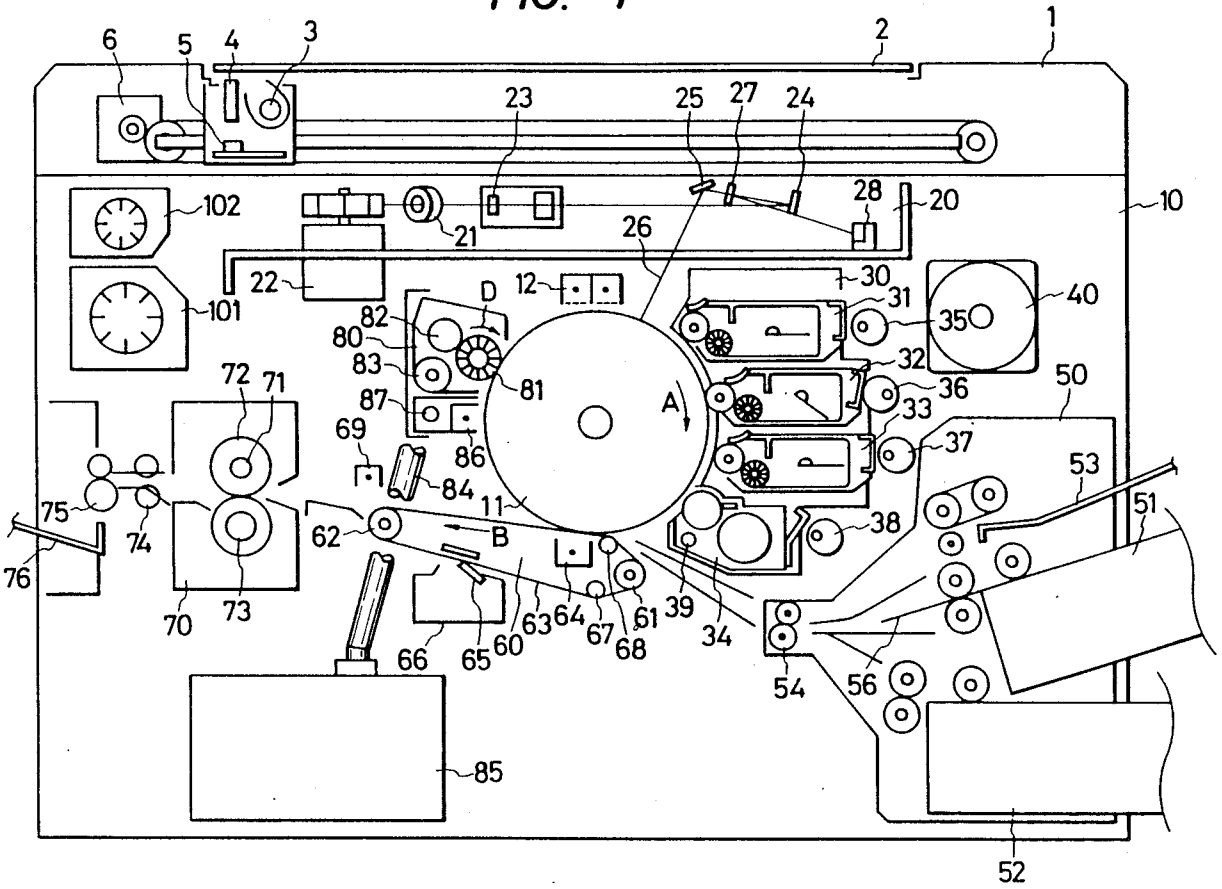
FIG. 1 is a diagram showing an arrangement of a multicolor electrophotography apparatus according to an embodiment of the present invention.

Referring now to FIG. 1, there is illustrated a digital color copying apparatus according to an embodiment of the present invention, which includes a reading section 1 which basically comprises an original bedplate 2, an original illuminating lamp 3, a lens system 4, a color line sensor 5, a drive system 6 for moving these devices in a secondary scanning direction, and an image processing circuit, not shown. Also included in the digital color copying apparatus is a writing section which comprises a cylindrical electrostatic image holder (which will be referred hereinafter to as photosensitive device) 11 which may be made of a Se system material sensitive to laser light whose wavelength is 780 to 810 n m. The photosensitive device 11 is supported to be rotatable in a direction indicated by a character A in the diagram. Numeral 12 represents a first electrifier for charging a surface of the photosensitive device 11 to a predetermined plus potential. Numeral 20 designates a laser optical system which is arranged such that a laser light beam indicated by numeral 26 is emitted from a laser generator 21 and the emitted laser light beam 26 reaches the surface of the photosensitive device 11 through a scanner 22, a lens system 23 and reflecters 24, 25 to effect the scanning of the surface of the photosensitive device 11. A portion of the laser light beam 26 is reflected by a reflecter 27 and received by a start-end detecting sensor 28. In the vicinity of the photosensitive device 11, i.e., at the right side thereof in the diagram, is provided a developing section 30 comprising a Y-developing device 31 for yellow-color development, a M-developing device 32 for magenta-color development, a C-developing device 33 for cyanogen-color development (which are referred hereinafter to as color developing devices), and a K-developing device 34 for black-color development. The Y-developing device 31, M-developing device 32 and C-developing device are respectively arranged as non-contact developing devices by which the development is performed by means of flying of a toner toward the photosensitive device 11, the toner being a non-magnetic one-component toner. The K-developing device 34 may be of the contact type by which the development is effected by the direct application of a developer including a two-component toner. Each of the developing devices 31 to 34 is arranged to assume two positions, one being in the state that it is close to the photosensitive device 11 and the other being in the state that it is relatively separated therefrom. That is, in development, each of the Y-developing device 31, M-developing device 32 and C-developing device 33 is horizontally moved toward the photosensitive device 11 by means of rotation of each of eccentric cams 35 to 37 which pushes the rear portion of each of the developing devices 31 to 33. On the other hand, the K-developing device 34 is rotated about a shaft 39 in response to rotation of an eccentric cam 38 so as to approach the photosensitive device 11. FIG. 1 shows the state that only the M-developing device 32 assumes the developable position. Numeral 40 represents a motor system for driving the eccentric cams 35 to 38 and the developing devices 31 to 34 and numeral 50 designates a paper-feeding section in which paper sheets can be fed one by one from each of cassettes 51, 52 and a manual paper-feeding portion 53. FIG. 1 shows the state that a paper sheet 56 is fed from only the cassette 51. The paper sheet 56 is fed through a resist roller 54 to below the photosensitive device 11. Numeral 60 represents a transfer and carrying section in which a semiconductive belt 63 is stretched between two rollers 61 and 62 and can assume two states, one being that a portion thereof is in pressure-contact relation to the photosensitive device 11 and the other being that the entire belt is in separated relation thereto. The belt 63 is rotated in a direction indicated by character B and the moving speed thereof is equal to that of the outer surface of the photosensitive device 11. FIG. 1 shows the state that a portion of the belt 63 is in contact relation thereto. Numeral 64 is a second electrifier which provides a high minus potential to the back surface of the paper sheet 56 fed through the belt 63 to between the belt 63 and the photosensitive device 11. The remaining toner on the belt 63 is removed by a cleaning blade 65 and the removed toner is withdrawn in a collection box 66 which is located below the cleaning blade 65. Numeral 69 represents a third electrifier which provides a minus corona to the paper sheet 56 when the paper sheet 56 is separated from the belt 63 and numeral 70 designates a fixing paper-ejecting section in which a heat roller 72, being heated by a fixing lamp 71, and a rubber roller 73 are arranged to be rotatable. At the rear side of the fixing paper-ejecting section 70 are provided paper-ejecting rollers 74, 75 and a paper-receiving tray 76. Numeral 80 depicts an electricity-removing section having a fur brush 81 which is rotatable in a direction indicated by character D and which can takes two positions, that is, the brush 81 is positioned to be in slight contact relation to the photosensitive device 11 and further to be in separated relation thereto. FIG. 1 shows that state that the brush 81 is in the contact relation thereto. A collection roller 82 is rotatable with it coming into contact with the brush 81. A minus voltage is applied to the brush 81 and the collection roller 82. Below the roller 82 is provided a collection screw 83 and a pipe 84 which extends to a collection box 85. Furthermore, below the brush 81 are a fourth electrifier 86 for plus-charging the toner on the photosensitive device 11 and an electricity-removing lamp 87 for removing the electricity of the photosensitive device 11, which are positioned so as to be in opposed relation to the photosensitive device 11. Numerals 101, 102 represent cooling fans for ventilation of the apparatus.

Operation of the above-mentioned digital color copying apparatus will be described hereinbelow. In response to depression of a copy button switch after original paper is set on the original bedplate 2, the original illuminating lamp 3 is energized to project an image of the original paper on the color line sensor 5 in line. The color line sensor 5 is repeatedly scanned in the principal scanning directions (directions of depth of the paper) at a high speed and moved by means of the drive system 6 in the secondary scanning direction (right direction of the paper). The color line sensor 5 simultaneously generates color signals R, G, B which are in turn inputted to the image processing circuit in series in correspondence with each of points of the original paper in response to the principal scanning and the secondary scanning. The image processing circuit generates black signal, yellow signal, magenta signal and cyanogen signal on the basis of the color signals R, G, B inputted at every point. Generally, in the color copying, the secondary scanning of the original paper is performed four times and the black signal outputted from the image processing circuit at the first secondary scanning is supplied to the laser generator 21 which in turn emits to the photosensitive device 11 a laser light beam 26 modulated in accordance with the inputted black signal. At this time, with the photosensitive device 11 being rotated in the direction of the arrow A, the photosensitive device 11 is evenly charged to +850 V by means of the first electrifier 12 and then the illuminated portion thereof is processed to become about +50 V in accordance with the laser light beam 26. The principal scanning of the photosensitive device 11 by the laser light beam 26 is performed by the scanner 22 and the secondary scanning thereof is performed by rotation of the photosensitive device 11 in the direction of the arrow A, while the repeating timing of this principal scanning is set to be in corresponding relation to the repeating timing of the principal scanning of the color line sensor 5 and further the moving speed of the outer surface of the photosensitive device 11 is set to be in corresponding relation to the moving speed of the color line sensor 5 in the secondary scanning direction, and therefore, concurrently with the reading of the original paper, a laser light beam 26 is emitted toward the photosensitive device 11 in accordance with the black signal for each of the points of the original paper so as to form a latent image of the copy original.

On the first secondary scanning in the reading section 1, the developing section 30 is set to the black-color developing state and only the K-developing device 34 is positioned to be close to the photosensitive device 11 by operation of the eccentric cam 38 and the other developing devices are respectively in the separated states. Thus, the latent image corresponding to the black signal formed by the laser light beam 26 is developed with a black-color toner by the K-developing device 34 without influence by the other developing devices. The image developed with the black-color toner reaches the transfer and carrying section 60 in accordance with the rotation of the photosensitive device 11. At this time, in the transfer and carrying section 60, rollers 67, 68 are positioned so as to be slightly rotated counterclockwise about the shaft of the roller 61 and the belt 63 is in the state that it is separated from the photosensitive device 11, thus resulting in no distortion of the image. Furthermore, the fur brush 81 is separated from the photosensitive device 11 with it being slightly rotated counterclockwise about the shaft of the collection screw 83, and therefore the image can pass again below the first electrifier 12 without distortion. The portion with the black-color toner image on the photosensitive device 11 is again charged by the first electrifier 12. As a result of the charging, the portion on which the toner is absent is electrified to +850 V and the toner portion is also electrified to +850 V seemingly.

When the end portion of the black-color toner image again reaches the position of illumination of the laser light beam 26 after electrified, in the reading section 1, the drive system 6 is controlled such that the color line sensor 5 again starts to scan the original paper from its end portion. In the second scanning in the reading section 1, a yellow signal is inputted from the image processing circuit to the laser generator 21, and the black-color toner image portion on the photosensitive device 11 is exposed under a laser light beam 26 modulated in accordance with the yellow signal. Because the end portion at which the scanning is started is the same as in the previous scanning and the scanning speed is also equal to that of the previous scanning, the black-color toner image and the yellow-color toner image are formed to be coincident in position with each other. The latent image formed in accordance with the yellow signal is developed with only the yellow toner so that the yellow-color toner image is formed in addition of the black-color toner image on the photosensitive device 11 because in the developing section 30 only the Y-developing device 31 is positioned to be close to the photosensitive device 11 and the other developing devices are positioned to be separated therefrom. At this time, this yellow development is performed in the state that the Y-developing device 31 is not brought into contact with the photosensitive device 11, thus resulting in no distortion of the previously formed black-color toner image.

Similarly, the magenta development and cyanogen development are further performed in the above-mentioned manner. Here, since the laser light passes through the magenta toner and yellow toner, if the exposing is effected when required, the exposed portion of the photosensitive device 11 is electricity-removed so that the magenta toner and cyanogen toner can be piled up on the yellow toner and further the cyanogen toner can be piled up on the magenta toner. After cyanogen toner image is formed finally, immediately before the end portion of the toner image reaches the transfer and carrying section 60, the transfer and carrying section 60 is set so that the belt 63 comes into light contact with the photosensitive device 11 and paper 56 is fed to be inserted between the photosensitive device 11 and the belt 63 by the resist roller 54 so that the end portion of the toner image and the end portion of paper 56 are coincident in position with each other. The toner image is transferred to the paper 56 by means of an electric field produced by the second electrifier 64 and simultaneously the paper 56 is conveyed by the belt 63 with it being attached thereto. The paper 56 is separated from the belt 63 when reaching the roller 62 because of a large curvature and the separated paper 56 then advances to the fixing paper-ejecting section 70. Here, in order to prevent the toner image on the paper 56 from being distorted due to peeling electrification occurring on the separation of the paper 56 from the belt 63, the third electrifier 69 provides minous corona from the above. The toner image on the paper 56 is fixed when the paper 56 passes through the fixing and ejecting section 70 and, after fixed, the paper 56 is placed on the receiving tray 76. On the other hand, the non-transferred toner remaining on the photosensitive device 11 is plus-charged by the fourth electrifier 86 which is operated immediately before the end of the toner-remaining portion reaches there and, at the substantial same timing, the remaining toner is shifted into the fur brush 81 by means of an electric field between the fur brush 81 and the photosensitive device 11. The toner being in the fur brush 81 is shifted to the collection roller 82 by means of an electric field applied between the collection roller 82 and the fur brush 81 and the toner on the collection roller 82 is then dropped to the collection screw 83 and collected into collection box 85 after passed through the pipe 84 whereby the surface of the photosensitive device 11 is cleaned. Furthermore, the surface thereof is electricity-removed by the electricity-removing lamp 87 to restore it to the initial state, resulting in preparing to the next copying operation. At this time, the toner present on the belt 63 of the transfer and carrying section 60 due to miss-operation or the like is cleaned by the cleaning blade 65 and dropped into the collection box 66.

Figure 2:
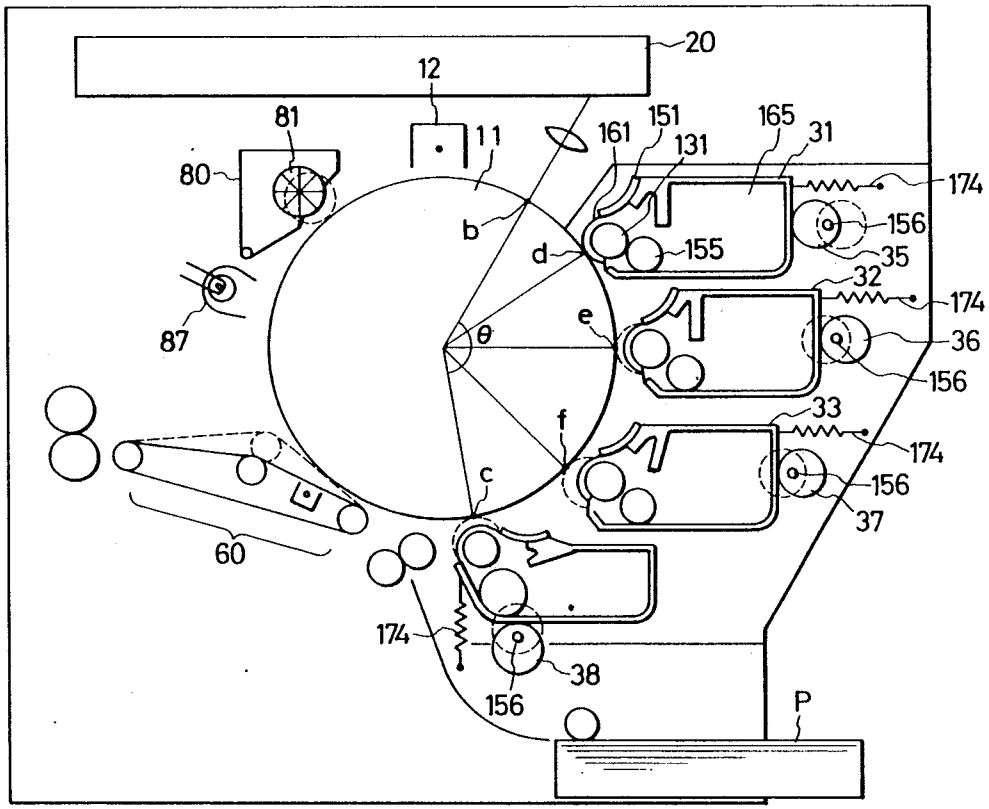
FIG. 2 is a diagram showing particularly an arrangement of a developing section of an multicolor electrophotography apparatus according to another embodiment of the present invention.
Figure 3:
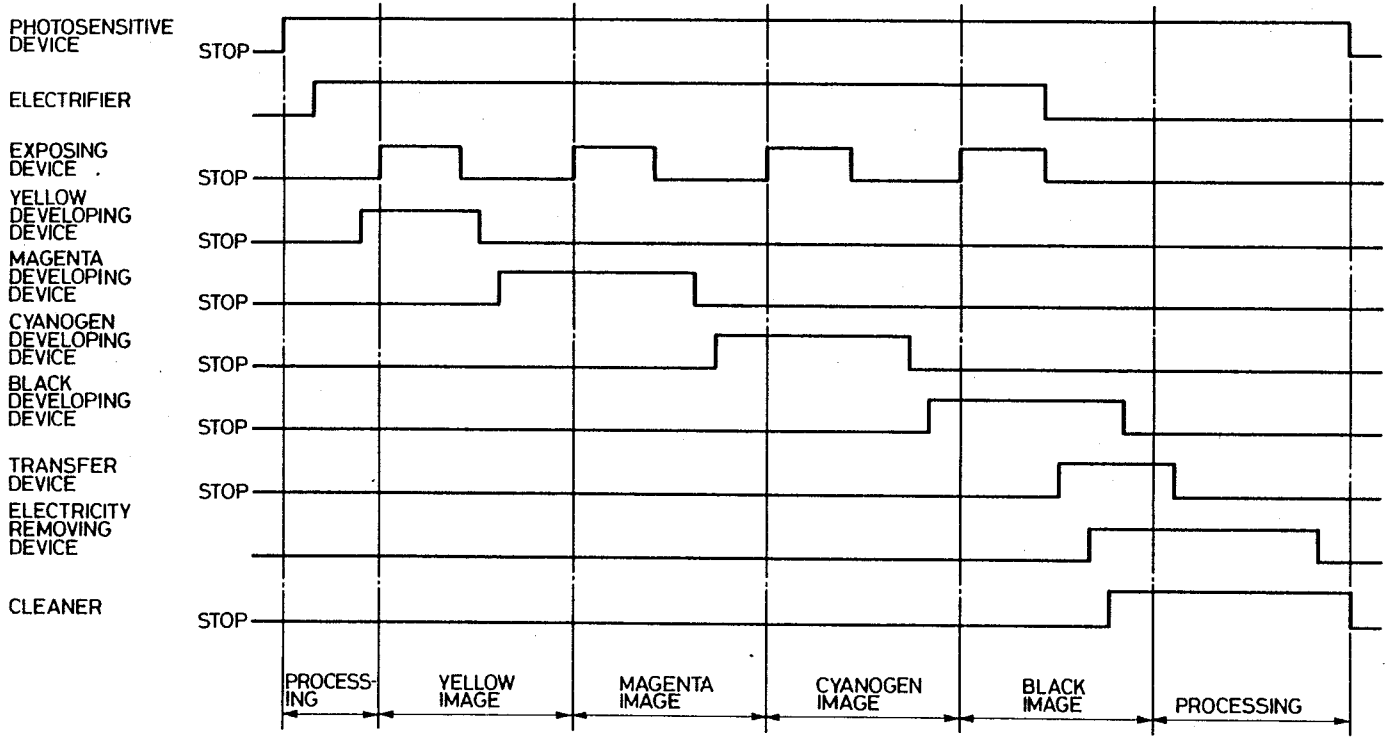
FIG. 3 is a timing chart for easily understanding operations of the FIG. 2 apparatus.

A further description of an embodiment of this invention will be made hereinbelow with reference to FIGS. 2 and 3. Detailed description of parts corresponding to those in FIG. 1 will be omitted. Here, the developing device 34 is described as the non-contact type device. In FIG. 2, the photosensitive device 11 has a circumference whose length L is L1+a where L1 is the maximum desired recording length and a is the advancing distance of the photosensitive device 11 during the time required for the movement of the developing devices 31 to 34 by the eccentric cams 35 to 38. In the vicinity of the circumference of the photosensitive device 11 are provided the first electrifier 12, an image-exposing means 20, and the four developing devices 31 to 34 in which a yellow developer, a magenta developer, a cyanogen developer and a black developer are encased, respectively. The length L2 on the photosensitive device 11 between the exposing position b of the image-exposing means 20 and the developing position c of the developing device 34 is arranged so as to be shorter by at least a than ½ of the entire circumference length L. The first electrifier 12, being a scorotron electrifier, charges evenly the photosensitive device 11 and the exposing means 20, comprising a LED array light source or a laser beam scanner light source, linearly exposes the photosensitive device 11 in the direction of the axis thereof. Each of the developing devices 31 to 34 comprises a developing roller 131, a developer receiving portion 165, a supply roller 155, a thickness-regulating member 151 for regulating the layer thickness of the developer attached to the developing roller 131, and a regulating roller 161 coaxially held at both ends of the developing roller 131, which are driven by a drive source, not shown. The developer in the developer receiving portion 165 is supplied through the supply roller 155 to the developing roller 131 and the developer on the developing roller 131 is regulated by the thickness regulating member 151 to be a thin layer. The regulating roller 161 is protruded slightly from the outer surface of the developer layer on the developing roller 131 so as to come into contact with both the end portions of the photosensitive device 11 on the development so that a predetermined space is provided between the developing roller 131 and the photosensitive device 11. Each of the developing devices 31 to 34 is supported to be reciprocatively movable in a developing guide, not shown, and moved toward the photosensitive device 11 against a spring 174 by means of rotation of each of the cams 35 to 38 which is fixedly secured to a rotating shaft 156. The rotation of each of the rotating shafts 156 is regulated by an electromagnetic clutch, not shown. To each of the developing rollers on development is applied a developing bias voltage. In the case of negative-positive inversion development, the polarity of this developing bias voltage is equal to the electrification polarity. The transfer and carrying section 60 electrostatically transfers a color image on the photosensitive device 11 to a recording sheet P and the cleaning electricity-removing section 80 removes the developer remaining on the photosensitive device 11.

A description of recording, whose length is L1/2, by the above-mentioned arrangement will be made hereinbelow with reference to a timing chart of FIG. 3. With the photosensitive device 11 being continuously rotated by means of a drive source, not shown, the surface of the photosensitive device 11 is charged evenly. When the charged region reaches the developing position d of the Y-developing device 31, for example, the electromagnetic clutch thereof is energized so that the Y-developing device 31 is moved toward the photosensitive device 11 by operation of the eccentric cam 35 so as to be set to the developing state. Thereafter, the exposing means 20 exposes the yellow image to form a latent image, thus resulting in successive development at the developing position d from the front end to the rear end of the image. After a formation of the yellow image has been terminated and the rear end of the image has passed the developing position d, the eccentric cam 35 is rotated so that the Y-developing device 31 is separated from the photosensitive device 11. Subsequently, when the front end of the image reaches the developing position e of the M-developing device 31 for second color, i.e., magenta, for example, the electromagnetic clutch thereof is energized so that the M-developing device 32 is similarly set to the developing state by means of the eccentric cam 36. The yellow image formed on the photosensitive device 11 passes through the transfer and carrying section 60 which is in the non-operated state, the electricity-removing lamp 87 and the electricity-removing section 80 and is again positioned below the first electrifier 12. The transfer and carrying section 60 and the electricity-removing section 80 is set to be in non-contact relation to the photosensitive device 11 when being in the non-operated state for the purpose of no influence to the passing image. At the position below the first electrifier, the photosensitive device 11 having the yellow image is again charged evenly by the first electrifier 12 and the image corresponding to the magenta color is exposed by the exposing means 20 in overlapping with the yellow image and then developed at the developing position e. After a formation of the magenta image has been terminated and the rear end of the image has passed the developing position e, the eccentric cam 36 is rotated so that the M-developing device 32 is separated from the photosensitive device 11. Thereafter, when the rear end of the image reaches the developing position f of the C-developing device 33 for cyanogen, i.e., the third color, the electromagnetic clutch thereof is energized so that the C-developing device 33 is set to the developing state by means of the eccentric cam 37. After passed through the transfer and carrying section 60, the lamp 87 and the electricity-removing section 80, the combination of the yellow image and the magenta image is again positioned below the first electrifier 12 where the photosensitive device 11 is evenly charged by means of the first electrifier 12. Thereafter, the image for cyanogen color is exposed by the exposing means 20 in overlapping with the combination image of the yellow image and the magenta image and developed at the developing position f. After a formation of the cyanogen image has been terminated and the rear end of the image has passed the developing position f, the eccentric cam 37 is rotated so that the C-developing device is separated from the photosensitive device 11. Subsequently, a similar process is performed for the black image at the developing position c, resulting in completion of the entire color image process. Here, preferably, an angle $\theta$ made of a line between a point on the axis of the photosensitive device 11 and the position b and a line between the same point and the position c is $0>\theta>\pi$. The color image formed on the photosensitive device 11 is transferred in the transfer and carrying section 60 to a recording sheet P carried. After the transfer, the photosensitive device 11 is electricity-removed by the lamp 87 and the remaining developer thereon is removed by the rotating brush 81 to cause the photosensitive device 11 to be restored to the initial state. On the other hand, the recording sheet P on which the color image is transferred is ejected through the fixing and ejecting section to the external.

Each of the developing devices 31 to 34 is of the non-contact non-magnetic one-component type that the developer is spattered by means of a direct current electric field. A thin developer layer whose thickness is about 30 micrometer is formed on the developing roller 131, made of aluminum, by the aid of the thickness-regulating member 151 provided above the developing roller 131. The developer is an insulating toner which is encased in each of the developing devices 31 to 34. The specification of the developing device and the condition of the development are as follows:

- diameter of the developing roller: 16 mm;
- peripheral speed of the developing roller: 150 mm/s;
- rotating direction of the developing roller: reverse to the rotating direction of the photosensitive device;
- separation between the photosensitive device and the developing roller: 150 micrometers on development and 2 millimeters on no development;
- electric charge amount: 3 $\mu$C/g;
- average particle diameter of developer: 10 micrometers.

The photosensitive device 11 has a diameter of 152.8 mm which allows the recording length of 420 millimeters and is driven by means of a stepping motor so as to allow a peripheral speed of 160 mm/s. Each of the eccentric cams 35 to 38 is rotated at a speed of 2 rps. The time required for movement of each of the developing devices 35 to 35 is set to below 0.25 seconds. A voltage of 7 kV is applied to the corona line of the first electrifier 12 so that the surface of the photosensitive device 11 is charged to 800 to 950 V. The exposing means 20 is arranged such that the light strength of the surface of the photosensitive device 11 is 3.5 mW. A semiconductor laser whose wavelength is 790 nm is used as the light source and the diameter of a spot of the laser beam is 90 micrometers. The recording density is set so that 16 beams is illuminated per 1 millimeter to form an electrostatic latent image. Under this conditions, the contrast voltage of the latent image is 750 V. The latent image is reversely developed by application of a developing bias voltage, which is lower by about 50 to 100 V than the surface potential, to the developing roller 131. In the case that recording whose length is 210 millimeters is performed under this condition, when on exposing the regulating rollers 161 of the developing devices 31 to 34 are brought into contact with the photosensitive device 11 and separated therefrom, an image distortion of about 5 millimeters occurs at the exposing position b. However, when being not in the exposing state, there is no image distortion irrespective of the movements of the developing devices 31 to 34. At this time, it is preferred that the maximum allowable distance between the exposing position b and the developing position c of the developing device 34 is below L/2−a where a is the moving distance of the photosensitive device 11 during the time required for movement of the development. In the case that recording whose length is 420 millimeters is performed with this arrangement, if the exposing and development are performed at every one revolution of the photosensitive device 11, a high-quality image can be obtained with the process being repeatedly performed four times. The formed yellow-image, magenta-image, cyanogen-image and black-image are accurately overlapped and the density of the combined color of red, green and blue is over 1.5 and the combination density of Y, M, C is over 1.7, thus resulting in a clear color print.

Figure 4:
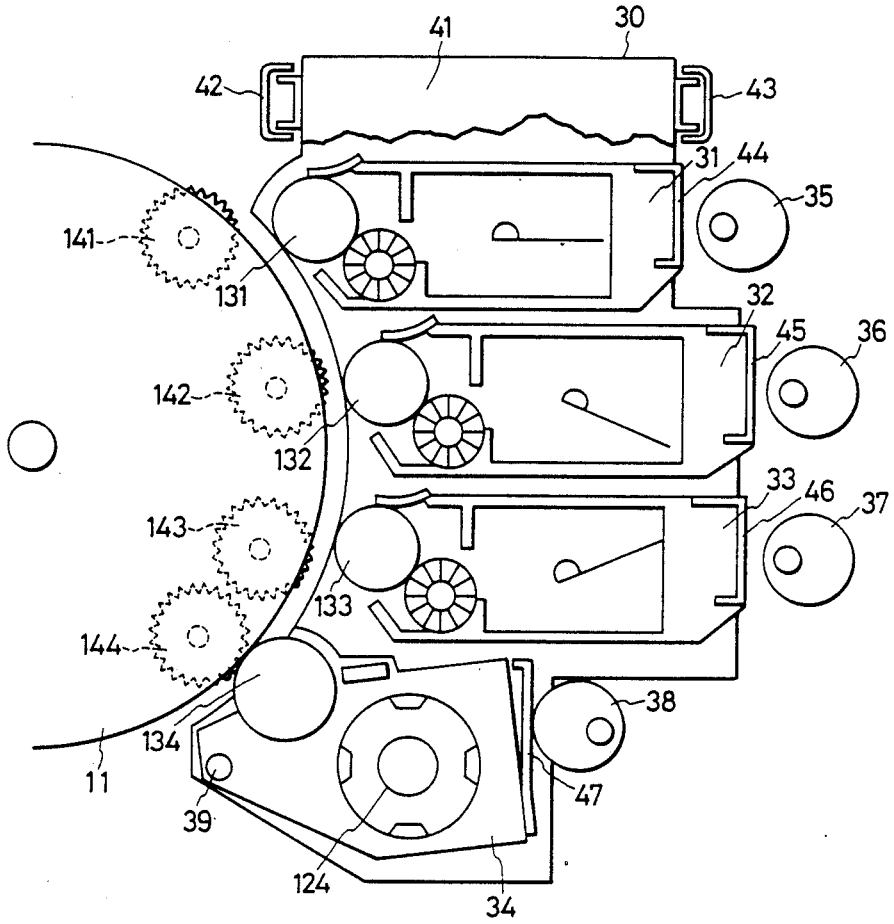
FIG. 4 is a cross-sectional view of a developing section of the FIG. 1 apparatus.
Figure 6:
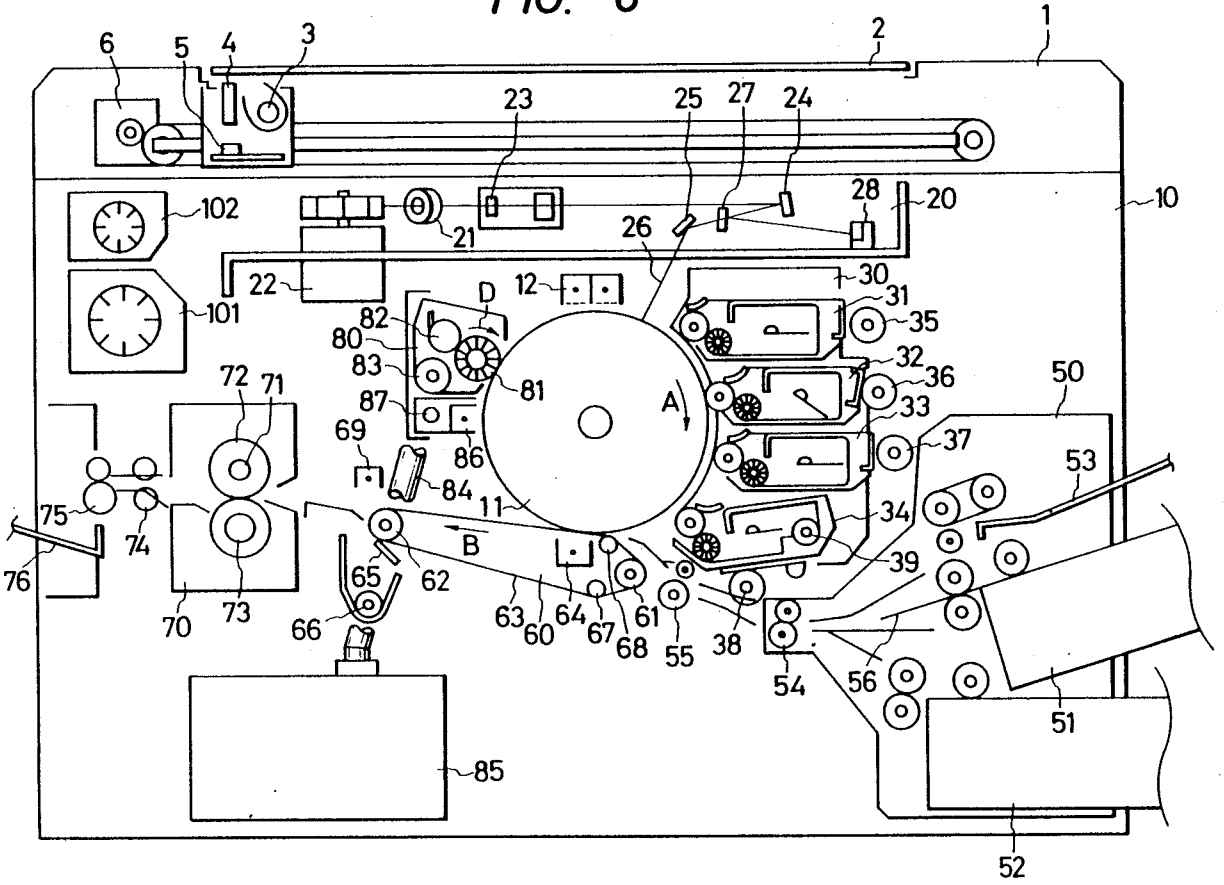
FIG. 6 is a diagram showing an arrangement of a multicolor electrophotography apparatus according to a further embodiment of the present invention.

A further detailed description of the photosensitive device 11 and the developing section 30 in FIG. 1 will be further described hereinbelow with reference to FIG. 4 which shows the state that the K-developing device is set to the developing state. In FIG. 4, the respective developing devices 31 to 34 is encased in a development rack 41 and have developing rollers 131 to 134, respectively, each of which is closed to the photosensitive device 11 on development and positioned to form a predetermined slight space with respect to the photosensitive device 11. The developing devices 31 to 33 are urged by return springs, not shown, provided in the development rack 41 so as to return to the positions shown in FIG. 4 when they are not in the developing state. On the other hand, the K-developing device 34 is rotated clockwise about the shaft 39 with it being pushed by the eccentric cam 38 as shown in FIG. 4 and rotated counterclockwise by its weight in response to release from the eccentric cam 38. Here, it is also appropriate that the eccentric cam 38 is provided under the K-developing device 34 as shown in FIG. 6. The respective eccentric cams 35 to 38 are encased in a housing of this apparatus and arranged to push the respective developing devices 31 to 34 through leaf springs 44 to 47. The rotation of each of the eccentric cams 35 to 38 is stopped at every 180° so that each of the developing devices 31 to 34 can take the closed state and separated state with respect to the photosensitive device 11. With all of the developing devices 31 to 34 being separated therefrom, the development case 41 can be arranged to be drawn out along rails 42, 43.

Figure 5:
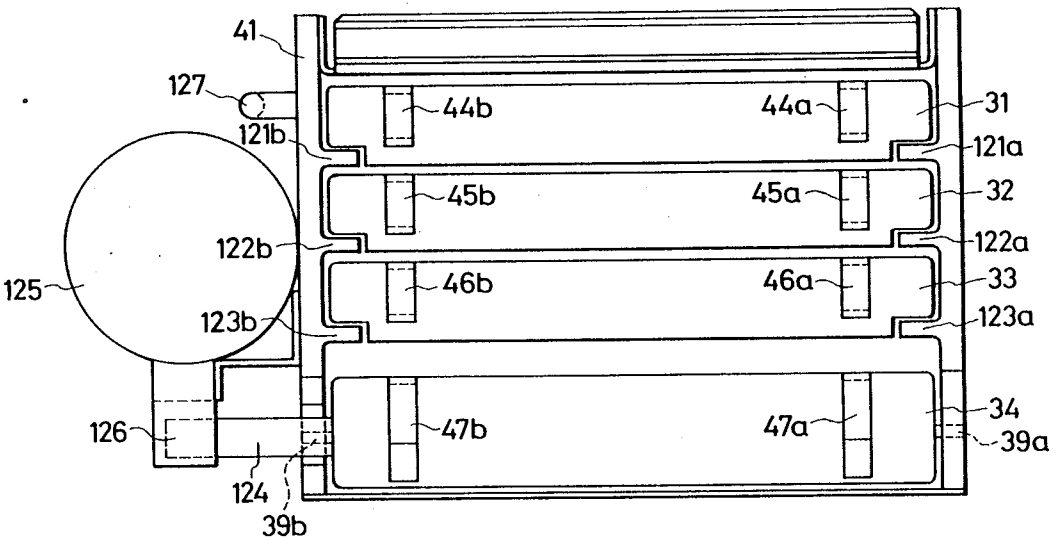
FIG. 5 is an illustration for describing a development rack of the FIG. 1 apparatus.

FIG. 5 is a rear side view of the developing section 30. As shown in FIG. 5, the developing devices 31 to 33 are respectively guided by guide members 121*a*, 121*b*, 122*a*, 122*b*, 123*a*, 123*b* so as to be movable toward the photosensitive device 11. On the other hand, the K-developing device 34 has a toner supply opening 124 so that the toner is received from a hopper 125 through a toner receiving portion 126. The hopper 125 is fixedly secured to the development rack 41. The toner supply opening 124 is guided so as to be freely movable up and down. Numeral 127 is a knob for drawing out the development rack 41.

As described above, since in this embodiment the three color developing devices are arranged to be horizontally moved so as to be closed and separated to and from the photosensitive device and only the K-developing device being at the lowest position is rotationally moved therefor, the space occupied, or required, for the developing section can be reduced and further it is possible to allow the developing device to accurately approach the photosensitive device to accurately keep the space, or distance, between the developing device and the photosensitive device on development, thus resulting in obtaining a high-quality image Furthermore, with the rotating shaft of the K-developing device being appropriately positioned, the developing roller can be brought into perpendicular contact with the surface of the photosensitive device. This means that it is possible to make smaller the size of the photosensitive device. In addition, since the K-developing device can receives the toner from the external, frequent removal thereof is not required.

Figure 7:
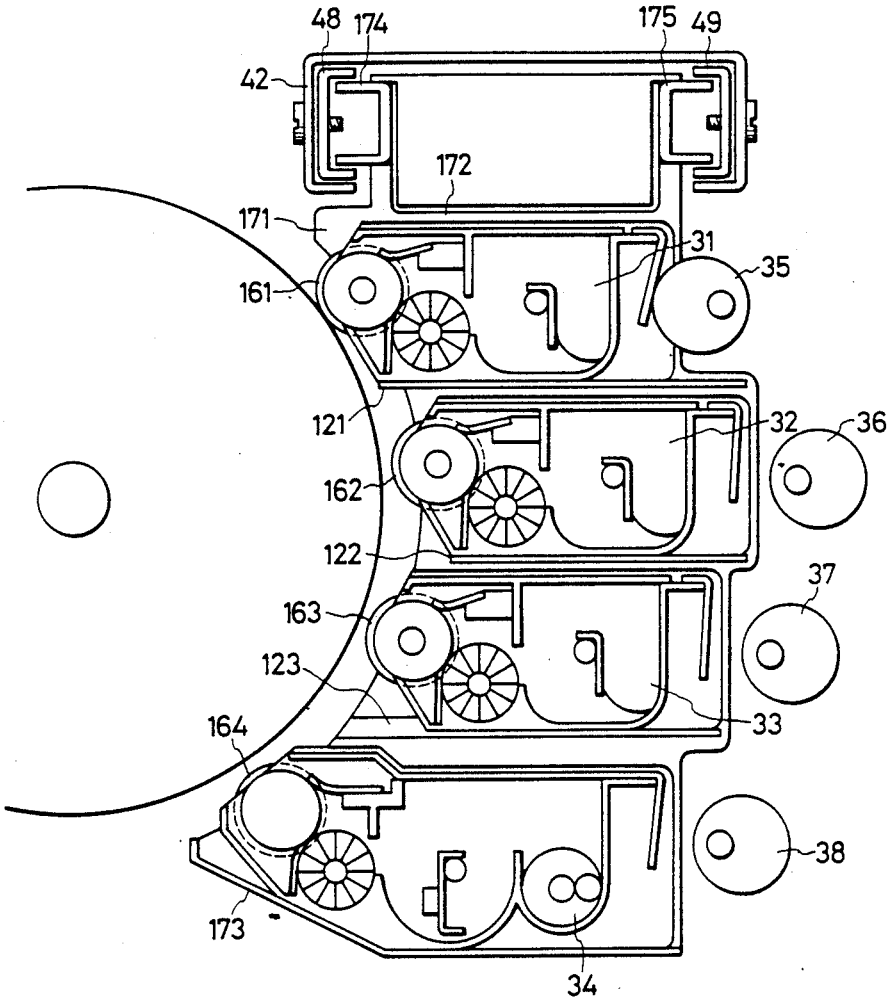
FIG. 7 is an illustration for describing a modification of the developing section of the FIG. 1 apparatus.
Figure 8:
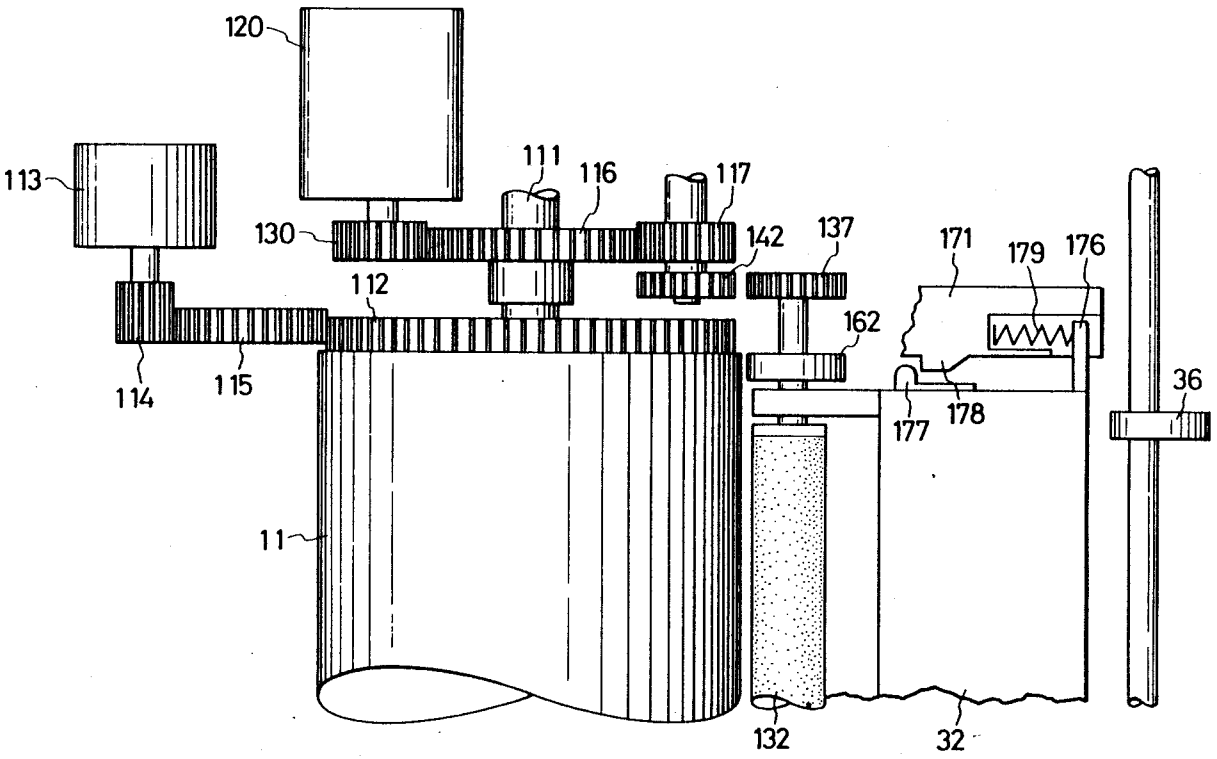
FIG. 8 is a plan view of a portion of the FIG. 7 developing section.
Figure 9:
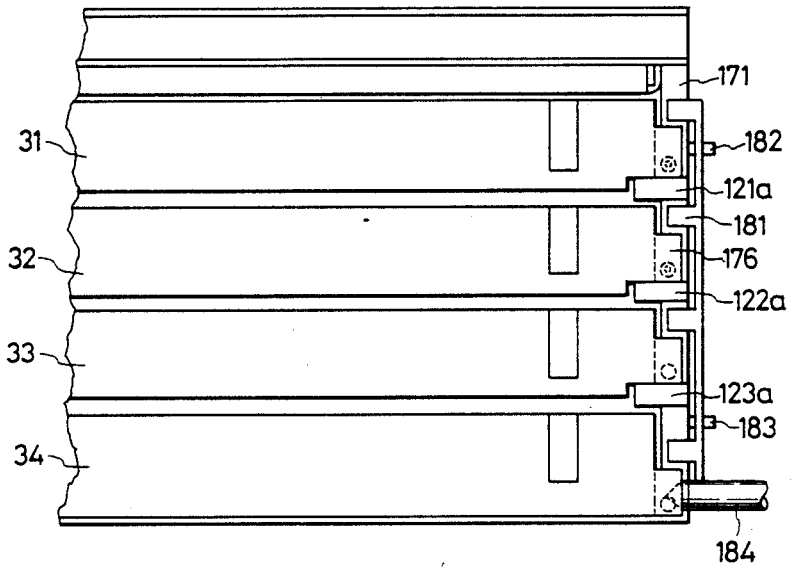
FIG. 9 is a partial diagram showing the rear side of the FIG. 7 developing section.

FIG. 7 shows another arrangement of the developing section 30. In FIG. 7, the developing devices 31 to 34 are encased in the development rack 41 up and down and horizontally guided by development guide members 121 to 123, 171 to 173. The development rack 41 is detachably guided by rack guide members 174, 175 in a direction of the rotation axis of the photosensitive device 11. The respective guide members 121 to 123 are provided on the development guide members 171 which are located so as to face both side surfaces of the developing devices. The development guide members 171 to 173 act as frames of the development rack 41. Furthermore, in the apparatus, tow-step rails 42, 48, 49 are provided in correspondence with the rack guide members 174, 175. FIG. 8 is a plan view of a portion of the developing section 30 of FIG. 7. In FIG. 8, at each of the development guide members 171 is provided a return spring 179 which is in opposed relation to a contact portion 176 of the rear portion of both the side surfaces of the developing devices 31 to 34. Furthermore, as shown in FIG. 8, elastic engaging portions 177 are provided at both the side surfaces of the developing device and projecting portions 178 are provided on the development guide members 171 in correspondence with the elastic engaging portions 177, so that the developing devices 31 to 34 are kept to predetermined positions at which they are separated from the photosensitive device 11 and are arranged to be freely detachable with respect to the development rack 41 in the substantially same direction as the separation and closing from and to the photosensitive device 11. Due to the engagement of the engaging portions 177 and the projecting portions 178 and further the end portion of the return spring 179, the separation position of the developing device is regulated. Furthermore, as shown in FIG. 9, holding means for keeping, on the removal and attachment of the development rack 41 with respect to the apparatus, the developing devices 31 to 34 to the non-developing state that they are separated from the photosensitive device 11 is provided on the development guide members 171. This holding means comprises holding members 181 movable up and down and shafts 182, 183 for guiding the movement thereof, the position relation being arranged such that, at the position that the holding members 181 has been fallen, the holding members 181 and the contact portions 176 provided at the rear portions of both the side surfaces of the developing device (32 for example) come into contact with each other. Furthermore, in the apparatus is provided a positioning shaft 184 for releasing the contact of the contact portions 176 of the developing devices 31 to 34 and the holding members 181 by lifting the holding members 181 up to an upper position and setting the development rack 41 to a predetermined position with respect to the photosensitive device 11 when the development rack 41 is installed to a predetermined position.

A description will be made hereinbelow in terms of the movements of the attachment and removal of the developing devices. With the development rack 41 being drawn out from the apparatus, the developing devices 31 to 34 are respectively inserted along the development guide members 121 to 123, 171 to 173 in a substantially horizontal direction from the right side of the drawing so as to be installed into the development rack 41. At this time, the holding members 181 of the holding means are at the fallen position taken by falling due to its weight, and when the developing devices 31 to 34 are inserted until the contact portions 176 and the holding members 181 come into contact with each other, due to this contact and the engagement of the projecting portions 178 and the engaging portions 177, the developing devices 31 to 34 is kept to the non-development state in which they are separated from the photosensitive device 11. When this development rack 41 is inserted into the apparatus, at a predetermined position immediately prior to the completion of the insertion, the holding members 181 is lifted to an upper position so that the non-development states of the developing devices 31 to 34 are released. Furthermore, the developing devices 31 to 34 is held by the engagement of the engaging portions 177 of the developing devices 31 to 34 and the projecting portions 178 of the development guide members 171 and further by the ends of the return springs 179.

As described above, since in this embodiment the approaching and separating directions of the developing devices 31 to 34 with respect to the photosensitive device 11 are substantially coincident with the removing and inserting directions thereof with respect to the development rack 41 and they are substantially horizontal, the arrangements of the developing devices 31 to 34 and the development rack 41 become simple and the removal and insertion of the developing devices 31 to 34 become easy and further it is possible to prevent the photosensitive device 11 from being damaged due to the movements of the developing devices 31 to 34.

Figure 10:
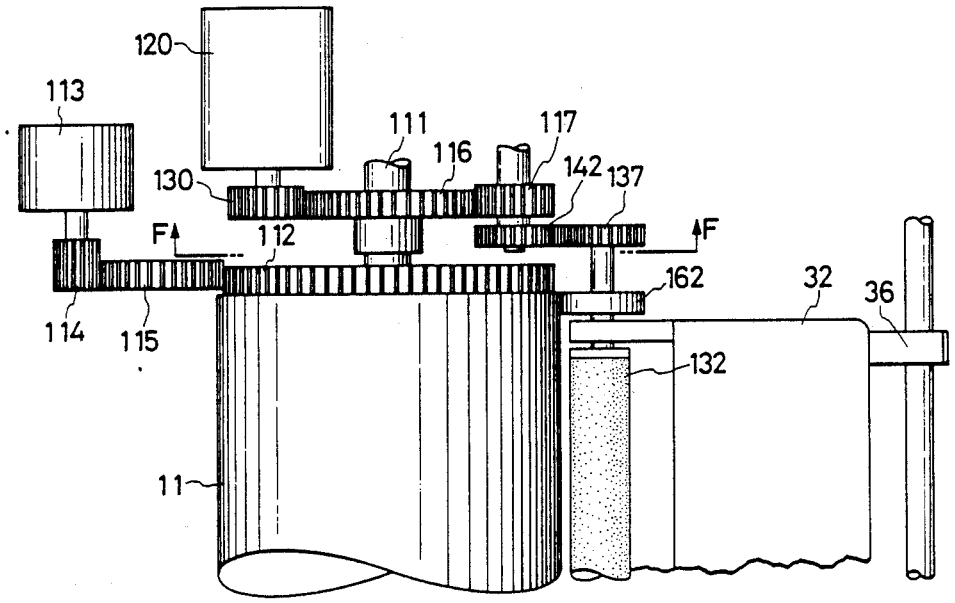
FIG. 10 shows a drive system for the photosensitive device and the developing device.

FIG. 10 shows the drive systems of the developing device 32 and the photosensitive device 11. In FIG. 10, the photosensitive device 11 is rotatably supported by a fixed shaft 111 and has at its side surface a toothed wheel 112 which is fixedly secured thereto. The photosensitive device 11 is rotated through toothed wheels 114, 115 and the toothed wheel 112 by means of a drive source 113. On the other hand, a center toothed wheel 116 is supported by the fixed shaft 111 and rotated through a toothed wheel 130 by a drive source 120. The center toothed wheel 116 is coupled to a buffering toothed wheel 117 which is in turn engaged through a drive force buffering portion (which will be described hereinafter) with a toothed wheel 142. To the end portion of the shaft of the developing roller 132 is fixedly secured a toothed wheel 137. When the developing device 32 is in the developing state, as shown in FIG. 10, the toothed wheel 137 is arranged so as to be engaged with the toothed wheel 142. Numeral 162 is a spacer roller which is rotatably supported by the shaft of the developing roller 132 and whose diameter is greater by 300 micrometers than that of the developing roller 132 so that, when the developing device 32 is in the developing state, the distance between the developing roller 132 and the photosensitive device 11 is set to be constant, i.e., 150 micrometers.

Figure 11:
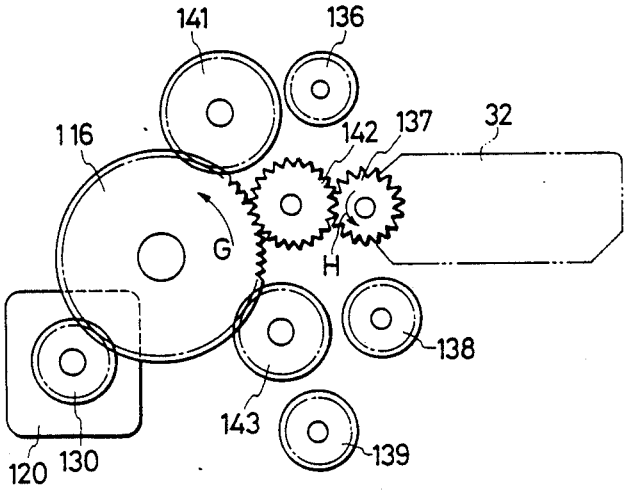
FIG. 11 is an illustration of a drive system for the photosensitive device and developing device.

FIG. 11 shows one example of the drive system of the developing section 30 in FIG. 6 apparatus and a cross-sectional view taken along F—F in FIG. 10 where only the developing device 32 is in the state closed to the photosensitive device 11 and the toothed wheel 137 and the toothed wheel 142 are engaged with each other and the toothed wheels of the other developing devices are separated from the corresponding toothed wheels 141, 143. When the center toothed wheel 116 is rotated in a direction indicated by character G, the toothed wheel 137 is rotated in a direction indicated by character H. Here, the K-developing device 34, as shown in FIG. 6, is arranged to be pushed by the eccentric cam 38 and released from the pushing so that its end portion is moved up and down to assume the developing state and non-developing state, and therefore, the toothed wheel 138 of the C-developing device 33 and the toothed wheel 139 of the K-developing device 34 are engaged with the same toothed wheel 143.

Figure 12A:
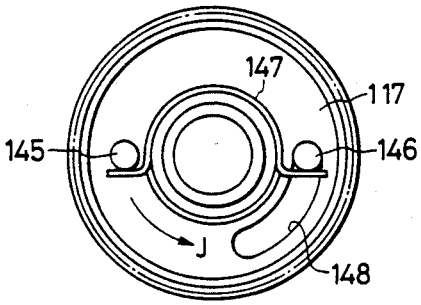
FIGS. 12A and 12B are illustration for describing a drive force buffering system set in a drive system of the developing device.
Figure 12B:
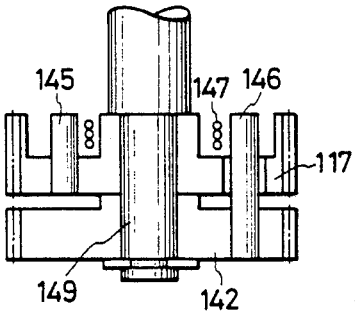

A description of the drive force buffering means which is set between the buffering toothed wheel and the toothed wheel 142 will be made hereinbelow with reference to FIGS. 12A and 12B. FIG. 12B is a cross-sectional view of the buffering toothed wheel 117, the toothed wheel 142 and so on viewed from the viewing direction of FIG. 10 and FIG. 12A is a top view thereof. The buffering toothed wheel 117 and the toothed wheel 142 are rotatably supported commonly by a shaft 149, while they are biased each other by means of a spring 147 whose ends are engaged with pins 145, 146 planted on the wheels 117 and 142. The biasing torque of the spring 147 has a value smaller sufficiently than the load torque of the developing device. When a load is not applied to the toothed wheel 142 in the non-developing state, the pin 146 is engaged with one end portion of an elongated hole 148 and the toothed wheels 117 and 142 are rotated together in the G-direction. When the M-developing device 32 is set to the developing state so that a load is applied to the toothed wheel 142, the load variation is not transmitted immediately thereto. The spring 147 is sagged to absorb the shock on the application of the load. When the load of the developing device 32 is further applied, since the spring 147 is set to be inferior to the torque due to the load, the pin 146 is engaged with the other end portion of the elongated hole 148 and the toothed wheels 117 and 142 are again rotated together.

As described above, in this embodiment the center toothed wheel 116 and the photosensitive device 11 are supported by the common shaft 111 and the parts of the drive system are engaged or disengaged with each other in accordance with the state of the developing device. Thus, the drive system can be simplified with high reliability, even if a number of developing devices are driven. Furthermore, the center toothed wheel 116 is driven independently of the drive of the photosensitive device 11 and therefore the drive of the developing device does not provide bad influence to the drive of the photosensitive device 11. In addition, the shock due to the load variation occurring on switching between the developing devices is absorbed by the aid of the drive force buffering means, thus resulting in prevention of the slippage of the image in position.

It should be understood that the foregoing relates to only preferred embodiments of the present invention, and that it is intended to cover all changes and modifications of the embodiments of this invention herein used for the purposes of the disclosure, which do not constitute departures from the spirit and scope of the invention.

What is claimed is:

1. A multicolor electrophotography apparatus comprising:

image-holding means substantially shaped cylindrically and arranged to be rotatable about its own axis, said image-holding means being arranged to hold an electrostatic image on its circumferential surface;

exposing means for linearly exposing the circumference of said image-holding means in a direction of the axis of said image-holding means so as to form said electrostatic image thereon;

a plurality of developing means movably provided along the circumference of said image-holding means, said plurality of developing means for developing a plurality of overlapping different-color toner images, each of said plurality of developing means having developer-holding means for application of a predetermined developer to said image-holding means;

drive means for allowing each of said plurality of developing means to take a developing position and a non-developing position, each of said plurality of developing means being close to said imaging-holding means when it is at said developing position and being separated therefrom when it is at said non-developing position, whereby said drive means causes rotational motion of at least one of said plurality of developing means which comprises a black-color developing device for forming a black-color toner image and horizontal motion of the other developing means which comprise color developing devices for forming different-color toner images between said developing position and said non-developing positions;

selection means coupled to said drive means for selectively controlling said plurality of developing means so as to selectively perform formations of said plurality of different-color images, said selection means controlling said drive means so that, when said exposing means is in a non-operated state, at least one of said plurality of developing means takes said developing position and the other developing means takes said non-developing position.

2. A multicolor electrophotography apparatus as claimed in claim 1, wherein said rotational moved developing means is arranged to perform the development with a magnetic, two-component developer with it coming into contact with said image-holding means, and the other developing means are arranged to perform the development with a non-magnetic, one-component developer with they being positioned in separated relation to said image-holding means.

3. A multicolor electrophotography apparatus as claimed in claim 1, wherein said rotational moved developing means is arranged to be coupled to developer supplying means so as to receive a developer therefrom, said developer supplying means being placed at the outside of said rotational moved developing means.

4. A multicolor electrophotography apparatus comprising:

image-holding means substantially shaped cylindrically and arranged to be rotatable about its own axis, said image-holding means being arranged to hold on its circumferential surface an electrostatic image;

exposing means for linearly exposing the circumference of said image-holding means in a direction of the axis of said image-holding means so as to form said electrostatic image thereon;

a plurality of developing means movably provided along the circumference of said image-holding means, said plurality of developing means developing a plurality of overlapping different-color toner images, each of said plurality of developing means having developer-holding means for application of a predetermined developer to said image-holding means; and rack means for encasing said plurality of developing means, said rack means having guide means whereby each of said plurality of developing means is slidingly movable to be closed toward said image-holding means and separated therefrom in a direction opposite to the closing direction to take a developing position and a non-developing position, said rack means being further arranged such that each of said plurality of developing means is removable therefrom and again inserted thereinto in directions substantially equal to the closing and separating directions.

5. A multicolor electrophotography apparatus as claimed in claim 4, wherein said rack means is arranged to be movable from an operating position to an non-operating position separated from said apparatus, said rack means having keeping means whereby each of said plurality of developing devices takes said non-developing position when moved to the non-operating position.

6. A multicolor electrophotography apparatus comprising:

image-holding means arranged to be rotatable about its own axis, said image-holding means being arranged to hold on its circumferential surface an electrostatic image;

a plurality of developing means movably provided along the circumference of said image-holding means, said plurality of developing means developing a plurality of overlapping different-color toner images;

selection means for selectively controlling said plurality of said developing means so as to selectively perform formations of said plurality of different-color images, said selection means performing control so that each of said plurality of developing means takes a developing position and a non-developing position, each of said plurality of developing means being closed to said image-holding means when it is at said developing position and being separated therefrom when it is at said non-developing position;

first drive means having first drive source means for driving said image-holding means so as to be rotated about a rotating shaft provided to be coaxially coincident with the axis of said image-holding means; and second drive means having second drive source means to operate each of said plurality of developing means for development, said second drive means being arranged to be engageable with said developing means when said developing means takes said developing position by said selection means and to be disengageable therewith when taking said non-developing position.

7. A multicolor electrophotography apparatus as claimed in claim 6, wherein said second drive means comprises transmission means for transmission of a drive force of said second drive source to said developing means, said transmission means comprising a toothed wheel which is rotatably supported by said rotating shaft.

8. A multicolor electrophotography apparatus as claimed in claim 7, wherein said transmission means further comprises drive force buffering means provided between said toothed wheel and said developing means for absorbing a shock occurring due to the drive of said developing means.

9. A multicolor electrophotography apparatus as claimed in claim 7, wherein said drive force buffering means comprises two toothed wheels which are coaxially arranged each other and are coupled through a spring to each other.

10. A multicolor electrophotography apparatus comprising:

image-holding means arranged to be rotatable about its own axis and to hold on its circumferential surface an electrostatic image;

exposing means for exposing the circumferential surface of said image-holding means to form the electrostatic image thereon;

a plurality of developing means disposed around the circumferential surface of said image-holding means for developing a plurality of overlapping different-color toner images, each of said plurality of developing means having developer-holding means for application of a predetermined developer to the circumferential surface of said image-holding means; and development-selection means for selectively causing each of said plurality of developing means to take a developing position and a non-developing position by closing and separating each of said plurality of developing means to and from said circumferential surface of said imaging-holding means, said developing-selection means including rotationally moving means for rotationally driving a lower one of said plurality of developing means with respect to said exposing means and horizontally moving means for horizontally driving the other developing means with respect to said exposing means.

11. A multicolor electrophotography apparatus as claimed in claim 10, wherein said developing means driven by said rotationally moving means is arranged so as to perform a black-color development with a magnetic, two-component developer, and the other developing means driven by said horizontally moving means are arranged so as to perform developments of colors other than a black color with a non-magnetic, one-component developer.

12. A multicolor electrophotography apparatus as claimed in claim 10, wherein said developing means driven by said rotationally moving means is engageable with developer supplying means to receive a developer therefrom, said developer supplying means is arranged so as not to be movable by means of said rotationally moving means.

13. A multicolor electrophotography apparatus comprising:

image-holding means arranged to be rotatable about its own axis and to hold on its circumferential surface an electrostatic image;

exposing means for exposing the circumferential surface of said image-holding means to form the electrostatic image thereon;

developing means disposed along the circumferential surface of said image-holding means for developing a plurality of overlapping different-color toner images on the circumferential surface of said image-holding means, said developing means having one developing device for performing a black-color development and a plurality of developing devices for performing developments of colors other than a black color; and development-selection means for selectively causing each of said developing devices to take a developing position and a non-developing position by closing and separating each of said plurality of developing devices to and from said circumferential surface of said image-holding means, said development-selection means including rotationally moving means for rotationally driving said black-color developing device and horizontally moving means for horizontally driving the other developing devices.

14. A multicolor electrophotography apparatus as claimed in claim 13, wherein said black-color developing device is arranged so as to perform the development with a magnetic, two-component developer, and the other developing devices are arranged so as to perform the developments with a non-magnetic, one-component developer.

15. A multicolor electrophotography apparatus as claimed in claim 13, wherein said black-color developing device is engageable with said developer supplying means to receive a developer therefrom, said developer supplying means is arranged so as not to be movable by means of said rotationally moving means.

* * * * *